United States Patent [19]

Ould et al.

[11] 4,172,772

[45] Oct. 30, 1979

[54] PRINTING PLATES

[75] Inventors: Marshall Ould, Leeds; Geoffrey N. Stevens, Harrogate, both of England

[73] Assignee: Vickers Limited, London, England

[21] Appl. No.: 895,720

[22] Filed: Apr. 12, 1978

[30] Foreign Application Priority Data

Apr. 16, 1977 [GB] United Kingdom ..... 15885/77

[51] Int. Cl.[2] ..... C25F 3/04

[52] U.S. Cl. ..... 204/129.85; 204/129.95

[58] Field of Search ..... 204/129.75, 129.85, 204/129.95, 129.1

[56] References Cited

U.S. PATENT DOCUMENTS

| | | | |
|---|---|---|---|
| 2,421,316 | 5/1947 | Carson | 204/129.95 |
| 3,963,594 | 6/1976 | Brasko | 204/129.8 |
| 4,052,275 | 10/1977 | Gumbinner | 204/129.75 |
| 4,087,341 | 5/1978 | Takahashi | 204/129.75 |

*Primary Examiner*—T. M. Tufariello

*Attorney, Agent, or Firm*—Reed, Smith, Shaw & McClay

[57] ABSTRACT

Aluminium or aluminium alloy is electrolytically grained using alternating current and an aqueous electrolyte comprising specified amounts of hydrochloric acid and a monocarboxylic acid containing from 1 to 4 carbon atoms, preferably acetic acid. The grained aluminium or alloy may be coated with a light sensitive layer to form a light sensitive plate for use in the production of lithographic printing plates by photomechanical techniques.

7 Claims, No Drawings

PRINTING PLATES

This invention relates to the electrolytic graining of aluminium and more particularly, but not exclusively, is concerned with the electrolytic graining of aluminium in the production of substrates suitable for use in the manufacture of light sensitive plates in lithographic printing plate production.

Lithographic printing plates are conventionally produced by a photomechanical technique from light sensitive plates comprising a substrate coated with a light sensitive composition. The light sensitive coating is image-wise exposed to actinic light so that parts of it are struck by light and become either more or less soluble in suitable liquids than those parts which are not struck by light. The image-wise exposed coating is then developed in such a liquid to selectively remove the more soluble parts of the coating. Those parts of the coating which remain on the substrate after development ordinarily constitute the water-repellent ink-receptive printing image of the printing plate and those parts of the substrate revealed on development ordinarily constitute the water receptive ink-repellent non-image areas of the printing plate. It will be apparent that the surface of the substrate should be such that the printing image can strongly adhere thereto and that it is readily wettable with water. It is known to improve the adhesion of the printing image and to improve the wetting characteristics of the non-image areas by roughening (conventionally referred to as graining) the substrate before applying the light sensitive coating.

The coarseness or depth of the surface grain of a substrate is usually measured by traversing a stylus across the surface to give an average reading on a meter. This average, known as the Roughness Average (Ra), is the arithmetical average of the departures of the surface profile above and below a reference line defined as being a line drawn such that the sum of the areas embraced by the surface profile above the line is equal to the sum of those below the line. Ra is normally measured in microns and is the result of several sampling lengths along the surface.

However, it will be appreciated that two surfaces having the same Ra values do not necessarily have the same type of grain. Thus, a surface having a grain of even depth i.e. all the depressions being of substantially the same depth could have the same Ra value as one having a grain of uneven depth, i.e. depressions of varying depth.

The type of grain required for the substrate of a light sensitive plate for lithographic printing plate production depends upon the requirements of the final printing plate. Thus a fine grain, i.e. shallow depressions, results in better reproduction of half-tones whereas a coarse grain, i.e. deep depressions, results in non-image areas having better wetting characteristics. In either case, however, it is important that the depressions are evenly spaced over the substrate surface and that they are close enough together so that peaks, rather than plateaus, are formed between the depressions.

It is known to grain substrates in lithographic printing plate production by an electrolytic technique. Normally this is effected by immersing the substrates in a suitable electrolyte and subjecting them to the action of alternating current. The use of hydrochloric acid as the electrolyte for graining substrates of aluminium is well known and this produces an even grain suitable for lithographic plates over a useful range of Ra values. However, when using hydrochloric acid as electrolyte in this way it is difficult to obtain an even grain with an Ra value of less than 0.8$\mu$ and it is necessary to carefully control the operating conditions, i.e. the acid concentration of the electrolyte in order to ensure consistent results.

It is also known to grain aluminium substrates using a mixture of hydrochloric acid and phosphoric acid as electrolyte. This produces an even grain having a lower Ra value than does hydrochloric acid alone but has the disadvantage that an excessive amount of smut is produced on the substrate. The presence of smut on the substrate can, in some cases, cause the light sensitive coating of the plate to become insolubilised during storage of the plate. Thus, the smut has normally to be removed. A further disadvantage of using a hydrochloric acid/phosphoric acid mixture as electrolyte is that it is difficult to produce grains having a range of Ra values i.e. the process is inflexible in respect of the type of grain which can be produced.

It has surprisingly been found that the use of an electrolyte comprising hydrochloric acid in admixture with certain carboxylic acids enables various types of electrolytic grain to be produced on aluminium substrates.

There are certain aluminium alloys whose use as substrates in lithographic printing plate production is particularly desirable, mainly because of their greater strength, but which are difficult to electrolytically grain satisfactorily using as electrolyte either hydrochloric acid alone or a mixture of hydrochloric acid and phosphoric acid due to the fact that both these electrolytes attack the impurities in the alloy and thus cause pitting.

It has surprisingly been found that the use of the aforementioned electrolytes comprising hydrochloric acid in admixture with certain carboxylic acids allows such aluminium alloys to be satisfactorily electrolytically grained.

Accordingly the present invention provides a method of electrolytically graining aluminium or an aluminium alloy, which comprises immersing the aluminium or aluminium alloy in an aqueous electrolyte comprising a mixture of hydrochloric acid and a monocarboxylic acid containing from 1 to 4 carbon atoms and passing an alternating current through the electrolyte, the concentration of hydrochloric acid in the electrolyte being from 0.05 to 0.5 M and the concentration of mono carboxylic acid in the electrolyte being from 0.05 to 2.20 M.

The carboxylic acid may be formic acid, propionic acid, or butyric acid but is preferably acetic acid.

Generally, the concentration of hydrochloric acid in the mixture will be from about 2 grams per liter to about 17 grams per liter (expressed as HCl) and the concentration of the carboxylic acid in the mixture will be from about 5 grams per liter to about 40 grams per liter. Preferably the molar ratio of hydrochloric acid:carboxylic acid in the mixture is from 2.7:1.0 to 1.0 to 7.0 respectively. Generally, the ratio of hydrochloric acid:carboxylic acid in the mixture will be from 1.1:1.0 to 1.0:10.0 on a grams per liter basis. It is particularly preferred to use an electrolyte comprising a molar ratio of hydrochloric acid:acetic acid of from 1:2, the hydrochloric acid concentration advantageously being 8.3 g/l (expressed as HCl) and the acetic acid concentration being 30 g/l.

The graining may be effected by means of a batch process using a sheet of the aluminium or aluminium alloy immersed in the electrolyte, the alternating current being passed through the electrolyte using the sheet as an electrode. A second similar sheet may be used as the second electrode. Alternatively, the graining may be effected by means of a continuous process by passing a continuous web through the electrolyte. In this case the electrodes used to introduce the alternating current into the electrolyte may be carbon electrodes located on opposite sides of the web.

The electrolytic graining may be effected at a voltage of, for example, from 5 V to 40 V, preferably from 9 V to 25 V for from 2 to 4 minutes. Generally, the current density should be from 3 to 4 amps per square decimeter. The electrolyte may be at any suitable temperature but is preferably from 25° to 30° C. and the electrode spacing will generally be from 10 to 100 mm.

Surprisingly, the presence of the carboxylic acid results in a grained surface having a lower Ra value than that obtained when using an electrolyte containing hydrochloric acid alone under otherwise similar conditions. Also, in the case where the carboxylic acid is acetic acid, the Ra value is dependent on the voltage rather than on the acid concentration and this makes control of the graining process simpler. In comparison with using a mixture of hydrochloric acid and phosphoric acid as electrolyte, a greater range of Ra values is obtainable using an electrolyte in accordance with the present invention and, moreover, the amount of smut produced is considerably less.

After graining, the aluminium or aluminium alloy may be anodised using alternating current, but preferably direct current, and, for example, sulphuric acid or phosphoric acid as electrolyte. Thereafter the grained surface (or the grained and anodised surface, as the case may be) of the aluminium or aluminium alloy may be coated with a light sensitive composition to form a light sensitive plate. The light sensitive composition may be a positive working composition, such as a mixture of a diazonium salt and a novolak resin, or a negative working composition, such as a photopolymerisable resin. The light sensitive plate may then be image-wise exposed and suitably processed to produce a lithographic printing plate.

The following Examples illustrate the invention.

EXAMPLE 1

Pairs of sheets of lithographic quality aluminium (99.5% Al) having an area of 1 $dm^2$ were immersed in aqueous electrolytes comprising different concentrations of hydrochloric acid. The distance between the sheets of each pair was 50 mm. A source of alternating current was connected across each pair of sheets and, in each case, current was passed for 2.0 minutes at an electrolyte temperature of 28° C. and at the voltages shown. The following results were obtained:

| Concentration | Voltage | Ra (μ) | Comment |
|---|---|---|---|
| | 9 V | 0.2 | very flat grain |
| 1% (4.3 g/l) | 12 V | 0.27 | flat grain |
| | 18 V | 0.90 | coarse uneven grain |
| | 25 V | 1.25 | coarse uneven grain |
| | 9 V | 0.30 | flat grain |
| 1.5% (6.5 g/l) | 12 V | 0.40 | flat grain |
| | 18 V | 1.15 | coarse even grain |
| | 25 V | 1.4 | coarse even grain |
| | 9 V | 0.35 | flat grain |
| | 12 V | 0.8 | coarse even grain |
| 2.0% (8.6 g/l) | 18 V | 1.0 | coarse even grain |
| | 25 V | 1.2 | coarse even grain |

The term flat used here signifies that plateaus rather than peaks were formed between the grain depressions.

It is clear from this Example that it is not possible to obtain an even grain having an Ra value of less than 0.8μ and that the variation in the concentration of the acid as well as the voltage causes variations in the Ra values.

EXAMPLE 2

Example 1 was repeated using aqueous electrolyes comprising the following mixtures of hydrochloric acid and phosphoric acid at various voltages with the following results:

| Concentration | | | | |
|---|---|---|---|---|
| HCl | $H_3PO_4$ | Voltage | Ra (μ) | Comment |
| 1.7% | 0.7% | | | |
| (7.3g/l) | (7.3g/l) | 9 | 0.28 | fine, even grain |
| | | 12 | 0.30 | " |
| | | 18 | 0.35 | " |
| | | 25 | 0.35 | " |
| 2.0% | 0.5% | | | |
| (8.6g/l) | (5.2g/l) | 9 | 0.2 | " |
| | | 12 | 0.25 | " |
| | | 18 | 0.30 | " |
| | | 25 | 0.30 | " |

In all the above cases an excessive amount of smut was produced. This example shows the limitation of a mixture of hydrochloric acid and phosphoric acid with regard to producing a range of Ra values.

EXAMPLE 3

Example 1 was repeated using aqueous electrolytes comprising the following mixtures of hydrochloric acid and acetic acid at various voltages with the following results:

| Concentration | | Voltage | Ra (μ) | Comment |
|---|---|---|---|---|
| HCl | $CH_3COOH$ | | | |
| 2%(8.6g/l) | 1% (10g/l) | 9 | 0.38 | fine, even grain |
| | | 12 | 0.75 | medium, even grain |
| | | 18 | 0.90 | coarse, even grain |
| | | 25 | 1.0 | coarse, even grain |
| 2%(8.6g/l) | 2%(20g/l) | 9 | 0.31 | fine, even grain |
| | | 12 | 0.65 | medium, even grain |
| | | 18 | 0.80 | coarse, even grain |
| | | 25 | 1.0 | coarse, even grain |
| 2%(8.6g/l) | 3%(30g/l) | 9 | 0.30 | fine, even grain |
| | | 12 | 0.50 | medium, even grain |
| | | 18 | 0.70 | coarse, even grain |
| | | 25 | 0.90 | coarse, even grain |
| 2%(8.6g/l) | 4%(40g/l) | 9 | 0.30 | fine, even grain |
| | | 12 | 0.62 | medium, even grain |
| | | 18 | 0.70 | coarse, even grain |
| | | 25 | 0.85 | coarse, even grain |
| 2.5%(10.75g/l) | 1.5%(15g/l) | 9 | 0.45 | fine, even grain |
| | | 12 | 0.60 | medium, even grain |
| | | 18 | 0.80 | coarse, even grain |
| | | 25 | 1.10 | coarse, even grain |
| 2.5%(10.75g/l) | 2.5%(25g/l) | 9 | 0.36 | fine, even, grain |
| | | 12 | 0.50 | medium, even grain |
| | | 18 | 0.75 | coarse, even grain |
| | | 25 | 1.00 | coarse, even grain |

This example shows that a range of Ra values can be produced by varying the voltage and that variations in the acid concentrations do not have any great effect on the Ra value produced.

EXAMPLE 4

4 sheets of aluminium were grained as in Example 3 using an aqueous electrolyte comprising 2% (8.6 g/l) of hydrochloric acid and 3% (30 g/l) of acetic acid. They were then anodised in an aqueous electrolyte containing 250 g/l sulphuric acid at 14 V and 20° C. for 3 minutes, rinsed and dried. The grained and anodised surface of each sheet was then coated with a light sensitive composition comprising the epoxy resin 4-azido-benzylidene-α-cyano acetic acid ester of Example 3 of U.K patent specification No. 1,377,747 to give a coating weight of 0.5 g/m$^2$. After drying the resultant light sensitive plates were exposed for 60 seconds in contact with negatives to a 8000 watt, pulsed xenon lamp at a distance of 0.65 m. The exposed plates were developed using a mixture of glycol ester and a wetting agent, rinsed with water and inked with greasy ink. Good, clean copies were obtained without difficulty.

EXAMPLE 5

Example 4 was repeated except that the sheets were anodised in an aqueous electrolyte containing 400 g/l of phosphoric acid at 30 V and 20° C. for 3 minutes. Similar results were obtained.

EXAMPLE 6

Example 4 was repeated except that the anodised surfaces of the grained sheets were coated with a positive working light sensitive composition consisting of a novolak resin and diphenylamine-4-diazonium fluoroborate and the resultant light-sensitive plates were exposed through positives to a 4,000 W pulsed xenon lamp for 2½ minutes at a distance of 2 ft and then developed with 1% sodium hydroxide solution. After rinsing and inking with a greasy ink, good clean copies were again obtained without difficulty.

EXAMPLE 7

Example 5 was repeated except that the anodised surfaces of the grained sheets were coated with the coating of Example 6 and were processed as in that example. Similar results were again obtained.

EXAMPLE 8

Example 1 was repeated using aqueous electrolytes comprising the following mixtures of hydrochloric acid and formic acid with the following results:

| Concentration | | | Ra | |
|---|---|---|---|---|
| HCl | HCOOH | Voltage | (μ) | Comments |
| 2%(8.6g/l) | 4%(40g/l) | 9 V | 0.25 | Slight attack |
| | | 12 V | 0.55 | fine flat grain |
| | | 18 V | 0.58 | medium flat grain |
| | | 25 V | 0.60 | coarse uneven grain |
| 2%(8.6g/l) | 10%(100g/l) | 9 V | 0.35 | slight attack |
| | | 12 V | 0.7 | flat grain |
| | | 18 V | 1.0 | medium flat grain |
| | | 25 V | 1.0 | medium flat grain |

EXAMPLE 9

Example 1 was repeated using an aqueous electrolyte comprising the following mixture of hydrochloric and propionic acid with the following results:

| Concentration | | | | |
|---|---|---|---|---|
| HCl | $CH_3CH_2COOH$ | Voltage | Rμ | Comments |
| 2%(8.6g/l) | 4%(40g/l) | 9 V | 0.4 | Fine grain |
| | | 12 V | 0.43 | " |
| | | 18 V | 0.46 | " |
| | | 25 V | 0.46 | " |

EXAMPLE 10

Example 1 was repeated using an aqueous electrolyte comprising the following mixture of hydrochloric acid and butyric acid with the following results:

| Concentration | | | | |
|---|---|---|---|---|
| HCl | $CH_3CH_2CH_2COOH$ | Voltage | Ra (μ) | Comments |
| 2% | 4% | 9 V | 0.35 | Slight attack |
| (8.6g/l) | (40g/l) | 12 V | 0.43 | Fine grain |
| | | 18 V | 0.35 | " |
| | | 25 V | 0.30 | " |

EXAMPLE 11

The aluminium alloys indicated in the following Table (which cannot be satisfactorily grained in an electrolyte containing hydrochloric acid alone or a mixture of hydrochloric acid and phosphoric acid) were grained as in Example 3 using an aqueous electrolyte comprising 2% (8.6 g/l) of hydrochloric acid and 3% (30 g/l) of acetic acid. The results obtained were similar to those obtained for the aluminium of Example 3.

| Alloy | Trace Constituents (remainder Al) | | | | | | Total Constituent Content (remain- |
|---|---|---|---|---|---|---|---|
| Number | Cu | Mg | Si | Fe | Mn | other | der Al) |
| 1 | 0.18 | <0.001 | 0.2 | 0.59 | 1.08 | — | 2.05 |
| 2 | 0.01 | 0.25 | 0.2 | 0.5 | 0.03 | — | 0.99 |
| 3 | 0.01 | 0.25 | 0.1 | 0.25 | 1.1 | — | 1.72 |
| 4 | 0.01 | 2.7 | 0.1 | 0.25 | 0.8 | 0.1 Cr | 3.96 |
| 5 | 0.01 | 1.0 | 0.1 | 0.25 | 0.25 | — | 1.61 |
| 6 | 0.01 | 0.25 | 0.1 | 0.25 | 1.1 | — | 1.71 |
| 7 | 0.1 | 0.45 | 0.15 | 0.5 | 1.0 | — | 2.20 |
| 8 | — | 0.85 | 0.95 | 0.31 | 0.01 | — | 2.12 |
| 9 | 0.15 | — | 0.20 | 0.52 | 1.1 | — | 1.97 |

We claim:

1. A method of electrolytically graining aluminium or an aluminium alloy, which comprises immersing the aluminium or aluminium alloy in an aqueous electrolyte comprising a mixture of hydrochloric acid and a monocarboxylic acid containing from 1 to 4 carbon atoms and passing an alternating current through the electrolyte, the concentration of hydrochloric acid in the electrolyte being from 0.05 to 0.5 M and the concentration of mono carboxylic acid in the electrolyte being from 0.05 to 2.20 M.

2. A method according to claim 1 wherein the carboxylic acid is formic acid, propionic acid or butyric acid.

3. A method according to claim 1 wherein the carboxylic acid is acetic acid.

4. A method according to claim 1, 2 or 3, wherein the molar ratio of hydrochloric acid: carboxylic acid is from 2.7:1.0 to 1.0 to 7.0 respectively.

5. A method according to claim 4 as appendant to claim 3 wherein the molar ratio of hydrochloric acid:-carboxylic acid is 1:2.

6. A method of making a light sensitive plate suitable for use in the production of a lithographic printing plate which method comprises the steps of (i) electrolytically graining aluminium or aluminium alloy by immersing the same in an aqueous electrolyte comprising a mixture of hydrochloric acid and a monocarboxylic acid containing from 1 to 4 carbon atoms and passing an alternating current through the electrolyte, the concentration of hydrochloric acid in the electrolyte being from 0.05 M to 0.5 M and the concentration of monocarboxylic acid in the electrolyte being from 0.05 to 2.20 M, and (ii) coating the grained aluminium or aluminium alloy with a light sensitive composition.

7. A method according to claim 6 and comprising the additional step of anodising the grained aluminium or aluminium alloy prior to coating with the light sensitive composition.

* * * * *

UNITED STATES PATENT AND TRADEMARK OFFICE

CERTIFICATE OF CORRECTION

PATENT NO. : 4,172,772

DATED : October 30, 1979

INVENTOR(S) : Marshall Ould and Geoffrey N. Stevens

It is certified that error appears in the above-identified patent and that said Letters Patent are hereby corrected as shown below:

Column 4, line 10, delete "electrolyes" and substitute --electrolytes--.

Column 6, line 44, delete

"50.01 1.0 0.1 0.25 0.25 - 1.61"

and substitute

--5 0.01 1.0 0.1 0.25 0.25 - 1.61.--

Signed and Sealed this

First Day of April 1980

[SEAL]

Attest:

SIDNEY A. DIAMOND

Attesting Officer

Commissioner of Patents and Trademarks